United States Patent [19]

Colace et al.

[11] Patent Number: 4,905,548

[45] Date of Patent: Mar. 6, 1990

[54] ADJUSTABLE SOCKET WRENCH EXTENSION

[76] Inventors: Ronald J. Colace, 22 Bonaire Dr., Dix Hills, N.Y. 11746; Anthony B. Deturris, Washington Blvd., Smithtown, N.Y. 11787

[21] Appl. No.: 278,762

[22] Filed: Dec. 2, 1988

[51] Int. Cl.[4] ..... B25G 1/04

[52] U.S. Cl. ..... 81/177.2

[58] Field of Search ..... 81/177.2; 16/115; 403/104, 342; 285/302

[56] References Cited

U.S. PATENT DOCUMENTS 3,338,607 8/1967 Broadhurst, Jr. ..... 403/342
4,277,197 7/1981 Bingham ..... 403/104
4,508,466 4/1985 Dennis ..... 403/104

FOREIGN PATENT DOCUMENTS 1147176 5/1983 Canada ..... 81/177.2

*Primary Examiner*—D. S. Meislin
*Attorney, Agent, or Firm*—Richard L. Miller

[57] ABSTRACT

This adjustable extension is designed for being employed with ratchet and hinge handle wrenches, and takes the place of different fixed length extensions for these wrenches. Primarily, it consists of telescoping members that are coupled together by knurled locking collars with O-rings. One end fits the drive end of a wrench and the other end is designed to be received in typical sockets that engage with nuts or bolts.

4 Claims, 1 Drawing Sheet

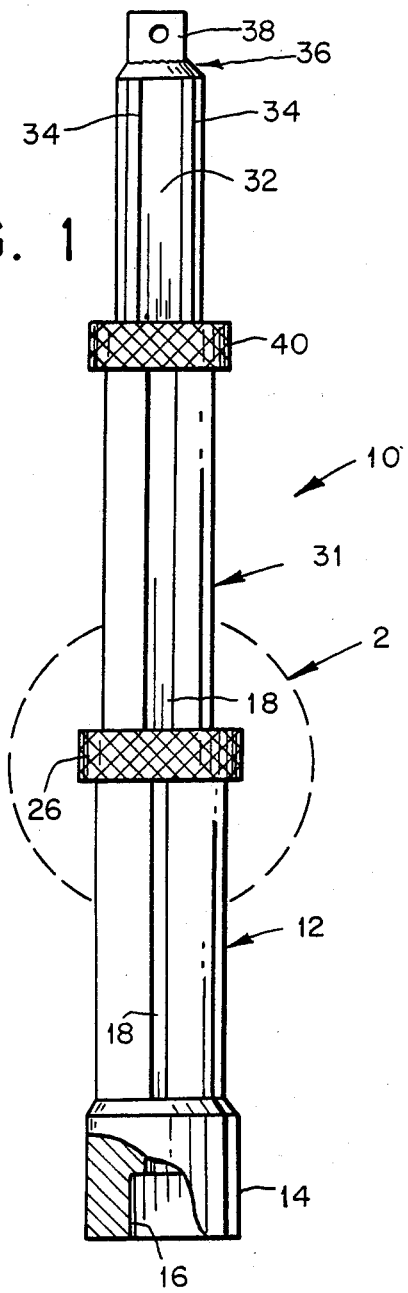
FIG. 1
FIG. 3
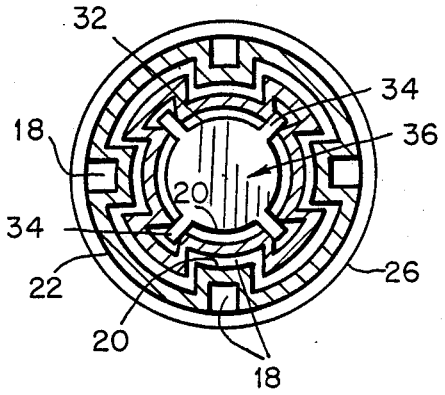
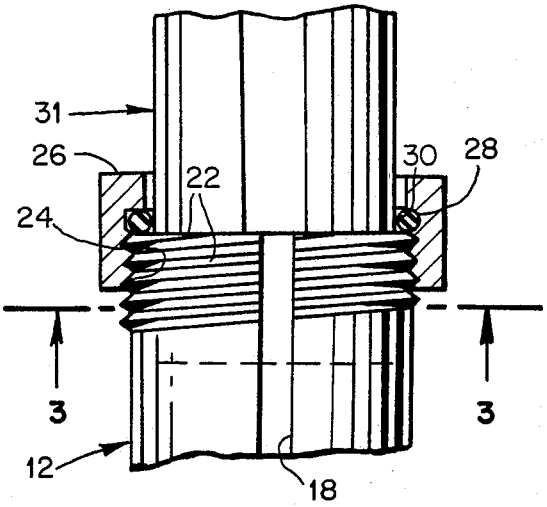
FIG. 2

ADJUSTABLE SOCKET WRENCH EXTENSION

BACKGROUND OF THE INVENTION

The instant invention relates generally to hand tools, and more particularly to an adjustable socket wrench extension.

Numerous tool devices have been provided in the prior art that are adapted to extend wrenches. While these units may be suitable for the particular purpose to which they address, they would not be as suitable for the purpose of the present invention as hereafter described.

SUMMARY OF THE INVENTION

A primary object of the present invention is to provide an adjustable socket wrench extension that will overcome the shortcomings of the prior art devices.

Another object is to provide an adjustable socket wrench extension that will be of such design, as to telescope to any desired length.

An additional object is to provide an adjustable socket wrench extension that will be of such design, as to lock in any desired length.

A further object is to provide an adjustable socket wrench extension that is simple and easy to use.

A still further object is to provide an adjustable socket wrench extension that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic vertical side elevational view of the instant invention shown partly broken away;

FIG. 2 is an enlarged fragmentary partial sectional view of a portion shown in the dotted circle indicated by arrow 2 in FIG. 1, of the invention shown partly broken away; and FIG. 3 is a cross sectional view taken on lines 3-3 of FIG. 2.

DETAILED DESCRIPTION OF THE PREFERRED EMBODIMENTS

Turning now descriptively to the drawings, in which like reference characters denote like elements throughout the several views, a wrench extension 10 is shown to include a first sleeve 12 having a hollow female drive end 14 with a square opening 16 that removably receives the drive end of a ratchet or hinge handle wrench (not shown). First sleeve 12 is essentially hollow and includes a plurality of equally and radially spaced longitudinal grooves 18 formed therein that also define an opposite longitudinal tongue 20 on the inner periphery of first sleeve 12, for a purpose which hereinafter will be described.

External threads 22 are provided on first sleeve 12 that engage with similar internal threads 24 provided in a locking and knurled first collar 26 that includes an 0-ring 28 that seats against an annular shoulder 30 within collar 26, and collar 26 is designed to lock first sleeve 12 to a second sleeve 31 when in extended position. The 0-ring 28 provides friction against the outer periphery of second sleeve 31 and the inner periphery of collar 26, as best seen in FIG. 2.

The tongues 20 are freely and slideably received in other similar grooves 18 provided in second sleeve 31, and the resulting tongues 20 of second sleeve 31 are freely and slideably received in equally and radially spaced longitudinal grooves 32 defined between ribs 34 integrally attached and projecting from a solid drive shaft 36 having a square projection 38 corresponding to the drive end of the ratchet wrench. This projection 38 is removably received in a typical socket (not shown) that is employed to engage with a nut or head of a bolt fastener.

A locking and knurled second collar 40 is similar in design to first collar 26 and is threaded onto the threaded end (not shown) of second sleeve 31, for the same locking cooperation of shaft 36 with the second sleeve 31.

It shall be recognized that the tongues and grooves herein described, serve to prevent rotation of the first sleeve 12, the second sleeve 31, and the drive shaft 36, with respect to each other while yet permitting relative sliding motion to take place between these sleeves when necessary for adjusting the extension to a suitable length.

In use, first collar 26 and second collar 40 are loosened by rotation, and second sleeve 31 is pulled outward of first sleeve 12, after which, shaft 36 is pulled outward from second sleeve 31. After the above, the first collar 26 and the second collar 40 are tightened to hold second sleeve 31 and shaft 36 extended. The extension 10 is then received on the wrench by the female drive end 14. The socket is then placed on the projection 38 of the shaft 36 for engagement with a nut or bolt fastener that is to be tightened or loosened by the wrench.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An adjustable socket wrench extension, which comprises:

(a) a first sleeve;

(b) a substantially hollow female drive end secured to said first sleeve, for the reception of a drive end of a ratchet wrench;

(c) a second sleeve telescopically received in said first sleeve;

(d) a solid drive shaft telescopically received in said second sleeve and providing a means for removably receiving a socket that engages wit a nut or head of a bolt of a fastener;

(e) a first locking collar and a second locking collar received on said first and second sleeves respectively, operable to engage said second sleeve and said drive shaft, respectively, for holding said first sleeve, said second sleeve, and said drive shaft extended; and (f) the first and second sleeves each having walls of substantially constant thickness and each wall being corrugated throughout its thickness defining alternating, longitudinally extending, tongues and grooves at equal radial spacings, the tongues and grooves on an inner surface of the first sleeve mating with respective grooves and tongues on an outer surface of the second sleeve and the tongues and grooves on an inner surface of the second sleeve mating with equally radially spaced grooves defined between equally radially spaced longitudinally extending ribs integrally joined with and projecting from said drive shaft; whereby the mating tongues and grooves and mating ribs and grooves permit relative longitudinal sliding movement while preventing relative rotation between said first sleeve and said second sleeve, and between said second sleeve and said drive shaft.

2. An adjustable socket wrench extension as set forth in claim 1, wherein said substantially hollow female drive end is integrally attached to said first sleeve and includes a longitudinal opening that removably receives a drive end projection of a ratchet or other wrench, and another end of said first locking collar, and said first locking collar is formed with a radially extending annular shoulder and includes a rubber O-ring within that seats against the annular shoulder, and said O-ring frictionally engages with an inner peripheral surface of said first locking collar and frictionally engages with an outer peripheral surface of said second sleeve.

3. An adjustable socket wrench extension as set forth in claim 2, wherein said second sleeve is externally threaded and threadingly receives a second locking collar receives an end of said drive shaft, the second locking collar being formed with a radially extending annular shoulder and including a rubber O-ring within that seats against the annular shoulder, said O-ring frictionally engaging with an inner peripheral surface of said second locking collar and with an outer peripheral surface of said drive shaft, and a projection is integrally attached to said drive shaft and removably receives said socket, and said first locking collar and said second locking collar when loosened by rotation enable said drive shaft and said second sleeve to be telescoped by a user to any desired position for a desired length of said wrench extension.

4. An adjustable socket wrench according to claim 1 wherein radially extending portions of the corrugated walls defining the tongues and grooves of the respective first and second sleeves have flat opposed surfaces.

* * * * *